United States Patent [19]

Kitchin et al.

[11] Patent Number: 4,777,118

[45] Date of Patent: Oct. 11, 1988

[54] PROCESS FOR THE FORMATION OF HIGH CONTRAST NEGATIVE IMAGES AND SILVER HALIDE PHOTOGRAPHIC ELEMENT

[75] Inventors: Jonathan P. Kitchin, Hertford, England; Carlo Marchesano, Savona, Italy

[73] Assignee: Minnesota Mining and Manufacturing Company, St. Paul, Minn.

[21] Appl. No.: 10,770

[22] Filed: Feb. 4, 1987

[30] Foreign Application Priority Data

Feb. 7, 1986 [IT] Italy ..... 19334A/86

[51] Int. Cl.[4] ..... G03C 1/06; G03C 1/42; G03C 5/26

[52] U.S. Cl. ..... 430/264; 430/265; 430/268; 430/439; 430/949

[58] Field of Search ..... 430/264, 265, 268, 439, 430/949

[56] References Cited

U.S. PATENT DOCUMENTS

| | | | |
|---|---|---|---|
| Re. 29,111 | 1/1977 | Masseth | 430/265 |
| 3,793,027 | 2/1974 | Okutsu et al. | 430/265 |
| 4,022,621 | 5/1977 | Hayashi et al. | 430/265 |
| 4,269,929 | 5/1981 | Nothnagle | 430/264 |
| 4,272,606 | 6/1981 | Mifune et al. | 430/264 |
| 4,560,638 | 12/1985 | Loblaw et al. | 430/264 |
| 4,619,886 | 10/1986 | Okutsu | 430/268 |

*Primary Examiner*—Paul R. Michl
*Assistant Examiner*—Mark R. Buscher
*Attorney, Agent, or Firm*—Donald M. Sell; Mark A. Litman

[57] ABSTRACT

High contrast negative images are obtained by developing a silver halide photographic element, in the presence of a hydrazine compound, with an alkali aqueous developing solution which contains a combination of developing agent comprising hydroquinone or substituted hydroquinone and a superadditive developing agent and an antioxidant, wherein the developing solution has a pH lower than about 12 and wherein the silver halide photographic element comprises an emulsion layer including surface latent image negative type silver halide grains in reactive association with a contrast promoting agent, preferably a diarylcarbinol compound, more preferably a diarylmethanol compound in a quantity useful to increase contrast.

18 Claims, No Drawings

PROCESS FOR THE FORMATION OF HIGH CONTRAST NEGATIVE IMAGES AND SILVER HALIDE PHOTOGRAPHIC ELEMENT

FIELD OF THE INVENTION

This invention relates to silver halide photographic light-sensitive elements and, more particularly, to silver halide photographic light-sensitive elements which provide high contrast negative images upon processing with a stable developing solution.

BACKGROUND OF THE ART

In the process for forming high contrast images by development of silver halide photographic elements necessary to obtain useful images for graphic arts processes, special developers known in the art as "lith" developers are used. The high contrast is achieved by means of the infectious development as described in Journal of the Franklin Institute, vol. 239, 221–230 (1945). These developers exhibit an induction period prior to the development of exposed silver halides, after which the infectious development occurs, which gives rise to the high contrast.

The typical "lith" developer contains only a single developing agent of the dihydroxybenzene type, such as hydroquinone. In order to enhance the infectious development, "lith" developers contain a low content of alkali sulfite. This low sulfite content renders the developer more prone to aerial oxidation, especially when it is used in combination with processing machines and, more particularly, with Rapid Access type processing machines, where the developer degradation is accelerated.

Moreover, the delay in start of development caused by the long induction period of hydroquinone developers lengthens the processing time and delays access to the finished material. While the induction period has been eliminated and processing time reduced by using the so called "Rapid Access" developers, which contain both hydroquinone and a superadditive developing agent such as phenidone or metol, these Rapid Access developers are not useful for lithographic purposes because they cannot produce the necessary high contrast. This is because Rapid Access developers have a high sulfite content which prevents infectious development and causes a lower contrast than "lith" developers.

Processes for obtaining a high contrast development of silver halide photographic emulsions have been disclosed. They are based on the addition of a hydrazine compound to a negative surface latent image type silver halide emulsion and on the development of the emulsion at a pH of about 12.8. The use of hydrazine compounds allows the use of auxiliary developing agents in combination with the dihydroxybenzene developing agents in order to increase the developing capacity. It also allows the use of relatively high sulfite concentrations to protect the developing agents against oxidation, and thereby increasing the developer stability. Anyhow, the high pH level necessary to obtain the high contrast from the use of hydrazine compounds makes the life of the developing solution relatively short.

The process which makes use of hydrazine is disclosed in U.S. Pat. Nos. 2,419,975; 4,168,977 and 4,224,401. Modifications and improvements to the hydrazine process are disclosed in U.S. Pat. Nos. 2,419,974; 2,410,690; 4,166,742; 4,221,857; 4,237,214; 4,241,164; 4,311,871; 4,243,739 and 4,272,614.

Despite the improvements which have been made in the hydrazine process, a remaining inconvenience was the relatively low stability of the developer to aerial oxidation, which is a consequence of the high pH required to achieve the desired high contrast.

Contrast promoting agents have been described in U.S. Pat. No. 4,269,929 and in European Patent Application Ser. No. 155,690 which, incorporated in the developing solution, allow the photographic element, including the hydrazine compound, to reach the desired high contrast at a low pH. It would be still desirable to obtain a photographic element providing a high contrast upon development in the presence of a hydrazine compound with a conventional Rapid Access type developer solution, without the necessary addition to said solution of ingredients of uncommon use such as the above mentioned contrast promoting agents.

SUMMARY OF THE INVENTION

This invention refers to a silver halide photographic element to be used with a high speed, Rapid Access developer formulation having an improved resistance to air oxidation and producing a high contrast negative image suitable for lithographic purposes. Advantages such as reduced dwell time in developer baths, reduced concentrations of ingredients in baths, reduced developer bath costs, and reduced concentrations of environmentally sensitive materials in wastes may be achievable by using silver halide emulsions having a contrast increasing effective amount of contrast promoting agents in reactive association with negative-acting surface latent image-type silver halide grains prior to imagewise exposure of the grains (i.e., development sensitizing exposure of the grains). Unique advantages such as high speed, high productivity, high degree of stability and high contrast can be achieved by developing a silver halide photographic element in the presence of a hydrazine compound with an aqueous alkaline developing solution which contains a combination of developing agents comprising hydroquinone or substituted hydroquinone and at least one superadditive developing agent and a useful amount of an antioxidant (such as a sulfite compound), wherein the developing solution has a pH of less than about 12 and wherein the silver halide photographic element comprises at least one silver halide emulsion layer including negative acting surface latent image-type silver halide grains in reactive association with a diarylcarbinol compound, preferably a diarylmethanol compound, in a quantity useful to increase contrast.

DETAILED DESCRIPTION OF THE INVENTION

In accordance with this invention, a silver halide photographic element is described for use in a process for obtaining a high contrast negative image by development of the exposed element, in the presence of a hydrazine compound, with an aqueous alkaline developing solution containing a dihydroxybenzene developing agent, a superadditive developing agent and an antioxidant at a pH lower than 12, wherein the silver halide photographic element comprises at least one emulsion layer including negative acting surface latent image-type silver halide grains in reactive association with a contrast promoting agent present in an amount effective to increase contrast. A "contrast promoting agent" is defined according to the present invention as a compound which when added to test developer (A) at a quantity of 10 grams per liter (or in an amount sufficient to give a saturated solution if this is less than 10 grams per liter) results in an increase in contrast of at least 20% (preferably 30%, more preferably at least 50%) when test film (B) is processed in test developer (A) for 80 seconds at 30° C., compared with the contrast when test developer (A) is used under the same conditions without any further additions. The contrast is measured between densities of 0.5 and 1.5.

Test Developer (A)

| | |
|---|---|
| Water | 750 $cm^3$ |
| Potassium hydroxide | 32 g |
| Sodium sulfite | 92 g |
| Ortho phosphoric acid 85% | 1.5 $cm^3$ |
| Ethylenediamine tetracetic acid disodium salt | 1.0 g |
| Sodium bromide | 3 g |
| Hydroquinone | 30 g |
| 1-Phenyl-4-methyl-3-pyrazolidone | 0.4 g |
| 5-methylbenzotriazole | 0.8 g |
| Water to make | 1,000 $cm^3$ |
| adjust pH to 11.6 finally and after any addition of CPA. | |

Test Film (B)

Test film (B) comprises a silver halide coating of the "hydrazine infectious development" type (described for example in U.S. Pat. No. 4,168,977) prepared as follows:

A cubic monodisperse emulsion of average grain size between 0.2μ and 0.3μ is precipitated by the conventional double jet procedure. The halide composition is Br 70%, Cl 28% and I 2%. The emulsion is desalted and coated at 3.5 g of silver per square meter and 3.0 g gelatin/$m^2$ on polyester base with the following additions.

| | |
|---|---|
| Sensitizing dye: Anhydro-5,5'-dichloro-9-ethyl-3,3'-bis-(3-sulfopropyl)-oxacarbocyanine hydroxide sodium salt | 200 mg/mole silver |
| Hydrazine derivative: 1-phenyl-2-formylhydrazine | 3.0 g/mole silver |
| Wetting agent: polyoxyethylene(20)cetyl ether | 1 g/mole silver |
| Hardener: 2-hydroxy-4,6-dichlorotriazine | 0.4 g/mole silver |
| pH adjusted to 5.0. | |

Unique properties and capabilities are achieved in the film and processes of the present invention when the contrast promoting agent comprises a diarylcarbinol compound, preferably a diarylmethanol compound, in a quantity useful to increase contrast.

Preferably, according to the present invention, the silver halide emulsion layer is reactively associated with a diarylcarbinol compound of formula (I) or (II):

$$R_1R_2R_3COH \quad (I)$$

$$R_1R_2R_3C(CH_2)_nOH \quad (II)$$

wherein $R_1$ and $R_2$ represent a substituted or unsubstituted aromatic group, $R_3$ represents a hydrogen atom, a substituted or unsubstituted alkyl group or a substituted or unsubstituted aromatic group and n represents a positive integer from 0 to 4 wherein $R_1$, $R_2$ and $R_3$ are bonded to the carbon atom in the formulae.

More preferably, according to the present invention, the silver halide emulsion layer is reactively associated with a diarylmethanol compound of formula (III):

$$R_1R_2CHOH \quad (III)$$

wherein $R_1$ and $R_2$ represent a substituted or unsubstituted aromatic group bonded to the carbon atom in formula (III).

More preferably, the aqueous alkaline developing solution according to the present invention has a pH lower than about 12, for example in the range from 9.50 to 12.00 or preferably from 10.00 to 11.50.

Still more preferably, the dihydroxybenzene developing agent is hydroquinone.

Most preferably, the superadditive developing agent is a 3-pyrazolidone compound, in particular a 1-phenyl-3-pyrazolidone. Still most preferably, the hydrazine compound is incorporated in the silver halide photographic element and preferably corresponds to the formula (IV):

$$R_4-NHNH-\underset{\underset{O}{\|}}{C}-H \quad (IV)$$

wherein $R_4$ represents a substituted or unsubstituted aromatic group.

The addition of the contrast promoting agents directly to the emulsion may enable reduction of the concentration of contrast promoting agents in the developing solutions with attendant reductions in cost and environmental impact. The use of the unique class of diarylcarbinols and diarylmethanols can even eliminate the need for additional contrast promoting agents in the developer solutions. These carbinol classes of compounds can also reduce the dwell time necessary in developer baths and enable the film to perform well at lower pH levels than films without these contrast promoting agents present in the film prior to contact with the developer solutions. The addition of the contrast promoting agents directly to the film has surprisingly not been found to adversely affect the sensitometry or characteristics of the film (e.g., graininess, sharpness, speed, Dmin, etc.).

The silver halide emulsions for use in the present invention may be silver chloride, silver chloro-bromide, silver iodo-bromide, silver iodo-chloride, silver iodo-chloro-bromide or any mixture of thereof. Generally, the iodide content of the silver halide emulsions is less than about 10% silver iodide moles, said content being based on the total silver halide. The silver halide emulsions are usually monodispersed or narrow grain size distribution emulsions, as described for example in U.S. Pat. Nos. 4,166,742; 4,168,977; 4,224,401; 4,237,214; 4,241,164; 4,272,614 and 4,311,871. The silver halide emulsions may comprise a mixtures of emulsions having different grain combinations, for example a combination of an emulsion having a mean grain size below 0.4μ with an emulsion having a mean grain size above 0.7μ, as described in Japanese Patent Application Ser. No. 57-58137 or a combination of two emulsions, both having a grain size below 0.4μ, such as for example a first silver halide emulsion having a mean grain size from 0.1 to 0.4μ and a second silver halide emulsion with particles having a mean grain volume lower than one half the particles of the first emlusion.

The silver halide grains of the emulsions of the present invention are capable of forming a surface latent image, as opposed to those emulsions forming an internal latent image. Surface latent image-forming silver halide grains are most employed in negative type silver halide emulsions, while internal latent image-forming silver halide grains, though capable of forming a negative image when developed in an internal developer, are usually employed with surface developers to form direct-positive images. The distinction between surface latent image and internal latent image-forming silver halide grains is well-known in the art. Generally, some additional ingredients or steps are required in the preparation of silver halide grains capable of preferentially forming an internal latent image instead of a surface latent image.

In the silver halide emulsions of the present invention, the precipitation or the growth of the silver halide grains may be carried out in the presence of metal salts or complex salts thereof, such as rhodium and iridium salts or complex salts thereof. According to the present invention, it has been found, anyhow, that the presence of rhodium or iridium is not necessary to obtain the high contrasts. Silver halide grains free of rhodium or iridium, as well as those formed or ripened in the presence of rhodium or iridium may be used to the purposes of the present invention.

The silver halide emulsions of the present invention may not be chemically sensitized, but are preferably chemically sensitized. As chemical sensitization methods for silver halide emulsions, the known sulfur sensitization employing sulfur compounds, the reduction sensitization employing mild reducing agents and the noble metal sensitization can be used, either alone or in combination.

The silver halide emulsions can be spectrally sensitized with dyes from a variety of classes, including the polymethine dye class, such as cyanines, merocyanines, complex cyanines and merocyanines (i.e., tri-, tetra- and poly-nuclear cyanines and merocyanines), oxonols, hemioxonols, styryls, merostyryls and streptocyanines.

The binder or protective colloid for the silver halide layer and the layers of the photographic element is preferably gelatin, but other hydrophilic colloids or synthetic water insoluble polymers in the form of latexes can be used to partially or completely replace gelatin.

In addition, the photographic elements of the present invention may also contain any photographic additives known in the art, such as for example stabilizers, antifoggants, hardeners, plasticizers, development accelerators, gelatin extenders, matting agents and the like.

To achieve the benefits of this invention, a hydrazine compound has to be present during development of the exposed element and the element must contain a diarylcarbinol compound prior to the contact with the whole developer solution. By "contact with the whole developer solution" is meant that the exposed element is placed into contact with all of the required developer ingredients.

The hydrazine compound can be incorporated in the photographic element or in the developing solution or both in the developing solution and in the photographic element.

Hydrazine and any water soluble hydrazine derivatives are effective to increase contact when incorporated in the developing solution in combination with the diarylmethanol compound incorporated in the photographic element. Preferred hydrazine derivatives to be used in the developing solution of this invention include compounds of formula:

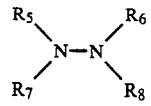

wherein $R_5$ is an organic radical and $R_6$, $R_7$ and $R_8$ each are hydrogen or an organic radical. Organic radicals represented by $R_5$, $R_6$, $R_7$ and $R_8$ include hydrocarbon groups, such as an alkyl group, an aryl group, an aralkyl group and an alicyclic group and such groups can be substituted with substituents such as alkoxy groups, carboxy groups, sulfonamido groups and halogen atoms.

Other examples of hydrazine derivatives, which can be incorporated in the developing solutions are hydrazides, acyl hydrazines, semicarbazides, carbohydrazides and aminobiuret compounds.

Specific examples of hydrazine derivatives, which can be incorporated in the developing solutions of the present invention, are disclosed in U.S. Pat. No. 2,419,575.

In a preferred form of this invention, the hydrazine compound is incorporated in the photographic element, for example in a silver halide emulsion layer or in a hydrophilic colloidal layer, preferably a hydrophilic colloidal layer adjacent to the emulsion layer in which the effects of the hydrazine compound are desired. It can, of course, be present in the photographic element distributed between the emulsion and the hydrophilic colloidal layers, such as a subbing layer, interlayers and protective layers.

Hydrazine compounds suitable to be incorporated into the photographic element according to the present invention are disclosed in GB Patent Specification No. 598,108 and in U.S. Pat. No. 2,419,974; they include the water soluble alkyl, aryl and heterocyclic hydrazine compounds, as well as the hydrazide, semicarbazide and aminobiuret compounds.

Particularly preferred hydrazine compounds, for use according to this invention incorporated in the photographic element, are the formylhydrazine compounds corresponding to the formula (IV):

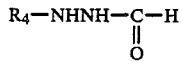

(IV)

wherein $R_4$ represents a substituted or unsubstituted aromatic group. Examples of aromatic groups represented by $R_4$ include a phenyl group and a naphthyl group. Such aromatic groups may be substituted with one or more substituents which are not electron attracting, such as straight or branched-chain alkyl groups (e.g. methyl, ethyl, propyl, isopropyl, n-butyl, isobutyl, n-ottyl, n-hexyl, tert.-octyl, n-decyl, n-dodecyl, etc.), aralkyl groups (e.g. benzyl, phenethyl, etc.), alkoxy groups (e.g. methoxy, ethoxy, 2-methyl-propyloxy, etc.), amino groups which are mono- or disubstituted with alkyl groups, acylaminoaliphatic groups (e.g. acetylamino, benzoylamino, etc.), etc., as disclosed in U.S. Pat. No. 4,168,977 and in CA Patent Specification No. 1,146,001. Such aromatic groups may also be substituted with a ureido group of formula:

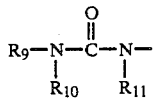

wherein $R_9$ and $R_{10}$ (which may be same or different) each represents hydrogen, an aliphatic group (such as a straight or branched-chain alkyl group, a cycloalkyl group, a substituted cycloalkyl group, an alkenyl group and an alkynyl group), an aromatic group (such as a phenyl group and a naphthyl group) or a heterocyclic group; $R_{11}$ represents hydrogen or an aliphatic group (such as those listed above) as described in U.S. Pat. No. 4,323,643.

Other hydrazine compounds, for use according to this invention incorporated in the photographic element, are those represented by the formula:

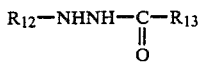

wherein $R_{12}$ represents the same aromatic group of the formula above and $R_{13}$ represents an alkyl group having 1 to 3 carbon atoms, which may be a straight or branched-chain alkyl (e.g. methyl, ethyl, n-propyl and isopropyl) or a phenyl group. The phenyl group may be substituted with one or more substituents which preferably are electron attracting groups, such as halogen atoms (chlorine, bromine, etc.), a cyano group, a trifluoromethyl group, a carboxy group or a sulfo group, etc. Specific examples of hydrazine compounds represented by the formula above are disclosed in U.S. Pat. No. 4,224,401.

Still other examples of hydrazine compounds, for use according to this invention incorporated in the photographic element, are those corresponding to the formula:

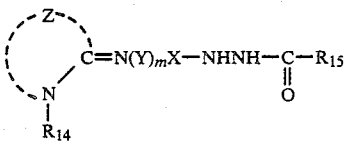

wherein $R_{14}$ represents hydrogen, an aliphatic group which may be substituted; Y represents a divalent linking group; m represents 0 or 1; X represents a divalent aromatic group (such as for example a phenylene group, a naphthylene group and the analogous substituted groups thereof); $R_{15}$ represents a hydrogen atom, an aliphatic group which may be substituted and Z represents a non metallic atom groups necessary to form a 5- or a 6-membered heterocyclic ring. Specific examples of hydrazine compounds represented by the formula above are disclosed in U.S. Pat. No. 4,272,614.

In one particular preferred form, the hydrazine compound to be incorporated in the photographic element is substituted with ballasting groups, such as the ballasting groups of incorporated color couplers and other non-diffusing photographic emulsion addenda. Said ballasting groups contain at least 8 carbon atoms and can be selected from the relatively non-reactive aliphatic and aromatic groups, such as alkyl, alkoxy, alkylphenyl, phenoxy, alkylphenoxy groups and the like.

Such hydrazine compounds can be incorporated in the photographic element using various methods well-known in the photographic art, the most common being the method of dissolving the hydrazine derivatives in a high boiling crystalloidal solvent and dispersing the mixture in the emulsion, as described for example in U.S. Pat. No. 2,322,027.

Hydrazine compounds incorporated in the developing solution in the practice of this invention are effective at very low levels of concentration. For example, hydrazine compounds give useful results in the developing solution in a quantity of about 0.001 moles per liter to about 0.1 moles per liter, more preferably in a quantity from about 0.002 to about 0.01 moles per liter. Hydrazine compounds incorporated in the photographic element are typically employed in a concentration ranging from about $5\times10^{-4}$ to about $5\times10^{-2}$ moles per miole of silver and preferably in a quantity from about $8\times10^{-4}$ to about $5\times10^{-3}$ moles per mole of silver.

The diarylcarbinol compounds, preferably the diarylmethanol compounds above, are incorporated into the photographic element prior to the contact with the whole developer solution and preferably prior to the exposure of the photographic element itself, such as for example when the diarylcarbinol compound is introduced into the element prior to the coating of the emulsion layer. For example they can be incorporated in the silver halide emulsion layer of the element or in a hydrophilic colloidal layer of the element, particularly a hydrophilic colloidal layer adjacent to the emulsion layer in which the effects of the diarylcarbinol compounds are desired. They can, for instance, be present in the photographic element distributed between the emulsion and the hydrophilic colloidal layers, such as for instance a subbing layer, interlayers and protective layers.

The aromatic groups represented by $R_1$, $R_2$ and $R_3$ of formulas (I), (II) and (III) above include a naphthyl group and, preferably, a phenyl group. The alkyl groups represented by $R_3$ of formulas (I) and (II) above include branched or straight-chain alkyl groups, preferably low alkyl groups (having from 1 to 5 carbon atoms). Such groups may contain substituents, such substituents being chosen in nature and size as not to negatively affect their behaviour according to the present invention. For what concern their nature, such substituents include for example an alkyl group, an alkoxy group, a cyano group, a dialkylamino group, an alkoxycarbonyl group, a carboxy group, a nitro group, an alkylthio group, a hydroxy group, a sulfoxyl group, a carbamoyl group, a sulfamoyl group, a halogen atom, etc. For what concerns their size, such substituents are preferred to have from 1 to 10 carbon atoms, more preferably from 1 to 5 carbon atoms.

Parameters to take into proper account are solubility and boiling point of the diarylcarbinol compounds of the present invention. Said compounds are to be substantially soluble in water of soluble in water miscible solvents (by "substantially soluble" in water it is meant that they are to be soluble in water in a quantity of at least 1% by weight and by "soluble" in water-miscible solvents it is meant that they are to be soluble in water miscible solvents in a quantity of at least 5% by weight) in order to introduce them into the aqueos coating compositions used to form the layers of the photographic elements according to the present invention. Said diarylcarbinol compounds are required to have a sufficiently high boiling point not to evaporate during drying of the layer forming coating composition. Said boiling points are preferably higher than 150° C., more preferably higher than 200° C.

Specific examples of diarylcarbinol compounds according to this invention include the following:

(1) diphenylmethanol (benzyhydrol)
(2) 4,4'-dimethoxydiphenylmethanol
(3) 4,4'-dimethyldiphenylmethanol
(4) 2,2'-dibromodiphenylmethanol
(5) 4,4'-dibromodiphenylmethanol
(6) 2,2'-dinitrodiphenylmethanol
(7) 4,4'-dinitrodiphenylmethanol
(8) 2,3'-dimethoxydiphenylmethanol
(9) 2,4'-dihydroxydiphenylmethanol
(10) 4-methyldiphenylmethanol
(11) 4-ethyldiphenylmethanol
(12) 2,2',4,4'-tetramethyldiphenylmethanol.

The diarylcarbinol compounds are used to the purposes of the present invention incorporated into the photographic element in amount from about $10^{-4}$ to about $10^{-1}$ mole per mole of silver, more preferably in an amount from about $10^{-3}$ to about $5\times10^{-2}$ mole per mole of silver.

According to the process of the present invention, the image-wise exposed silver halide photographic element can be processed with a stable aqueous alkaline developing solution to produce a high contrast negative image. This contrast is the slope of the straight line portion of the characteristic sensitometric curve (referred to as "average contrast") and is measured between two points located at densities of 0.10 and 2.50 above fog. Averages contrast higher than 10 can be obtained according to this invention by developing an image-wise exposed element comprising the diarylcarbinol compound, in the presence of a hydrazine compound, at a pH lower than the pH necessary to obtain the high contrast with the use of the hydrazine compound alone. As a consequence of the lower pH in the developer bath and the presence of the diarylcarbinol compound in the element, the process can be carried out to obtain the desired high contrast characteristics by using a conventional Rapid Access type developing solution stable during the time to the aerial oxidation (the higher the pH the lower being the stability of the developing solution, as known to the skilled in the art) independently from the presence of contrast promoting agents in the developing solution of the type described in the above mentioned U.S. Pat. No. 4,269,929 and European Patent Application No. 155,690.

The dihydroxybenzene developing agents employed in the aqueous alkaline developing solution for use in the practice of this invention are well-known and widely used in photographic processings. The preferred developing agent of this class is hydroquinone. Other useful dihydroxybenzene developing agents include chlorohydroquinone, bromohydroquinone, isopropylhydroquinone, tolylhydroquinone, methylhydroquinone, 2,3-dichlorohydroquinone, 2,5-dimethylhydroquinone, 2,3-dibromohydroquinone, 1,4-dihydroxy-2-acetophenone-2,5-dimethylhydroquinone, 2,5-diethylhydroquinone, 2,5-di-p-phenethylhydroquinone, 2,5-dibenzoylhydroquinone, 2,5-diacetaminohydroquinone and the like.

The 3-pyrazolidone developing agents employed in the aqueous alkaline developing solution for use in the practice of this invention are also well known and widely used in photographic processings. The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include: 1-phenyl-5-methyl-3-pyrazolidone, 1-p-aminophenyl-4-methyl-4-propyl-3-pyrazolidone, 1-p-chlorophenyl-4-methyl-4-ethyl-3-pyrazolidone, 1-p-acetamidophenyl-4,4-diethyl-3-pyrazolidone, 1-p-$\beta$-hydroxyethylphenyl-4,4-dimethyl-3-pyrazolidone, 1-p-hydroxyphenyl-4,4-dimethyl-3-pyrazolidone, 1-p-methoxyphenyl-4,4-diethyl-3-pyrazolidone, 1-p-tolyl-4,4-dimethyl-3-pyrazolidone, and the like.

The aqueous alkaline photographic developing composition for use in the practice of this invention contains a sulfite preservative at a level sufficient to protect the developing agents against the aerial oxidation and thereby assure good stability characteristics. Useful sulfite preservatives include sulfites, bisulfites, metabisulfites and carbonyl bisulfite adducts. Typical examples of sulfite preservatives include sodium sulfate, potassium sulfite, lithium sulfite, ammonium sulfite, sodium bisulfite, potassium metabisulfite, sodium formaldehyde bisulfite salt and the like. Also ascorbic acid is a known preservative agent against aerial oxidation of the developer for use in the bath according to this invention.

The aqueous alkaline developing solutions for use in the practice of this invention can vary widely with respect to the concentration of the various ingredients included therein. Typically, the dihydroxybenzene developing agent is used in an amount of from 0.040 to about 0.70 moles per liter, more preferably in an amount of from 0.08 to about 0.40 moles per liter; the 3-pyrazolidone developing agent is used in an amount of from about 0.001 to about 0.05 moles per liter, more preferably in an amount of from about 0.005 to about 0.01 moles per liter; the sulfite preservative is used in an amount from about 0.03 to about 1.0 moles per liter, more preferably in an amount from about 0.10 to about 0.70 moles per liter.

In contrast with "lith" developers which require a low level of sulfite ions, the developing solutions of this invention can utilize higher levels of sulfite ions, and thereby achieve the advantages of increased stability, since a higher level of sulfite ions provides increased protection against aerial oxidation.

In carrying out the method of this invention, it is preferred to use an organic antifogging agent to minimize fog formation in the processed element. The organic antifogging agent can be incorporated in the photographic element or can be added to the developing solution or can be both incorporated in the photographic element and added to the developing solution. According to the present invention, it has been found that more preferred organic antifogging agents for specific use in the developing solutions are benzotriazole and/or a benzimidazole antifogging agents, which proved to have beneficial effects on increasing contrast. Useful compounds are both substituted and unsubstituted benzotriazole and benzimidazole compounds, with the proviso that electron withdrawing substituents at least as strong as nitro groups are excluded. As a matter of fact, nitro substituted benzotriazole and benzimidazole compounds, although good to prevent fog, do not provide beneficial effects with reference to contrast increase. Benzimidazoles and benzotriazoles, as a class, are believed to be useful in the practice of this invention. Anyhow, as indicated, difficulties in obtaining significantly improved performance with benzotriazoles and benzimidazoles having strong electron withdrawing groups have been encountered. Benzotriazoles and benzimidazoles are therefore preferred not to have any substituents on the aromatic rings which are electron attracting groups as strong as or stronger than a nitro group. Other substituents known in the art such as lower alkyl groups (having 1 to 5 carbon atoms) and halogen substituents (chlorine) proved to be substituents good to the purposes of the invention. Said benzotriazole and benzimidazole antifogging and contrast promoting agents are normally used in amounts effective to prevent fog, although quantity can be optimized to get the best results from the contrast point of view. Useful quantities, when they are included in the emulsion, may vary from 1 to 100 milligrams per 100 grams of emulsion and, when included in the developing bath, as preferred, may vary from 0.01 to 5 grams per liter.

In addition to the essential components specified hereinabove, the developing solutions can optionally contain any of a wide variety of addenda, as known, useful in photographic developing solutions. For example, they can contain solvents, buffers, sequestering agents, development accelerators, agents to reduce swelling of the emulsion layers, and the like.

The invention is further illustrated by the following examples.

EXAMPLE 1

A cubic silver chlorobromide emulsion $Ag_{0.15}Cl_{0.85}$ of narrow grain size distribution and mean grain size of 0.23μ was prepared by the conventional double jet procedure. The emulsion was then coagulated and washed in the conventional manner and reconstituted to give a final gelatin to silver ratio of 100 g gelatin/silver mole. A coating composition was prepared by mixing this emulsion with:

a wetting agent, 2-hydroxy-4,6-dichloro-1,3,5-triazine hardener (0.4 g/mole Ag), anhydrous 5,5'-dichloro-9-ethyl-3,3'-bis-(3-sulphopropyl)oxacarbocyanine hydroxide sodium salt green sensitizing dye (0.2 g/mole Ag) and 1-formyl-2-{4-[2-(2,4-di-t-pentylphenoxy)-butyramido]-phenyl}-hydrazide compound (1 g/mole Ag).

A comparison coating (Sample 1) was then prepared by the application of the described mixture onto a subbed polyester base at a silver coverage of 3.8 g/m². A second coating according the invention (Sample 2) was prepared using a similar coating composition but with further addition of benzydrol compound (1 g/mole Ag). Strips of samples 1 and 2 were exposed in a sensitometer consisting of a 500 watt tungsten filament light source attenuated by a 0–4 continuous neutral density wedge in contact with the film sample. The strips were then developed for 80 seconds at 28° C. in a developer of the following composition:

| | |
|---|---|
| Potassium hydroxide | 33 g/l |
| Sodium sulphite | 90 g/l |
| Ethylene diaminotetraacetic acid disodium salt | 1 g/l |
| Sodium bromide | 3 g/l |
| Hydroquinone | 30 g/l |
| 4-methyl-1-phenyl-3-pyrazolidone | 0.4 g/l |
| 5-methylbenzotriazole | 0.8 g/l |
| pH adjusted to | 11.50 |

The strips were then fixed, washed and dried. Densitometric evaluation of the strips showed the characteristics listed in the following Table 1:

TABLE 1

| Sample | Speed * | Average Contrast ** | Toe Contrast *** |
|---|---|---|---|
| 1 | 1.0 | 2.8 | 3.2 |
| 2 | 1.2 | 15.6 | 9.7 |

*Relative Log Sensitivity at density 0.2 above fog;
**Contrast measured between density 0.1 and 2.5 above fog;
***Contrast measured between density 0.07 and 0.17 above fog.

The addition of the diarylcarbinol compound according to the invention promotes the high contrast effect of the hydrazide at a development pH below that which would otherwise be required.

EXAMPLE 2

Two silver halide emulsions were prepared having the following characteristics:

Emulsion 1: $AgCl_{0.28}Br_{0.70}I_{0.02}$ with mean grain size of 0.23μ

Emulsion 2: $AgCl_{0.98}I_{0.2}$ with mean grain size of 0.10μ

The emulsion were mixed in molar ratio of emulsion 1:emulsion 2=1:4. The mixed emulsions were coated as described in Example 1 (Sample 1) however replacing the hydrazide with a 1-formyl-2-[4-(4'-phenylureido)-phenyl]hydrazide compound (3 g/mole Ag) and a total silver coating weight of 2 g/m² was used (comparison coating Sample 3).

A second coating according the invention (Sample 4) was prepared using a similar coating composition but with the further addition of benzhydrol compound (1 g/mole Ag).

A third coating according to the invention (Sample 5) was prepared using a coating composition similar to sample 3 but with the further addition of 4,4'-dimethoxydiphenylmethanol compound (1 g/mole Ag).

A fourth coating (comparison coating sample 6) was prepared using a coating composition similar to sample 3 but with the further addition of benzyl alcohol (1 g/mole Ag).

A fifth coating (comparison coating sample 7) was prepared using a coating composition similar to sample 3 but with the further addition of phenylmethylcarbinol (1 g/mole Ag).

The coatings were exposed and processed as described in example 1, with the exception that pH was 11.00. Densitometric characteristics of the strips are listed in the following Table 2:

TABLE 2

| Sample | D. Max | Speed | Average contrast | Toe contrast |
|---|---|---|---|---|
| 3 | 0.4 | 0.4 | — | 0.2 |
| 4 | 4.2 | 1.2 | 13.5 | 3.5 |
| 5 | 4.2 | 1.2 | 13.8 | 3.7 |
| 6 | 0.4 | 0.4 | — | 0.3 |
| 7 | 0.4 | 0.4 | — | 0.3 |

The results show that in the absence of the diarylcarbinol compounds or in the presence of benzyl alcohol or aralkyl alcohols very low contrast and maximum density are achieved under these development conditions. On the contrary, the coatings made with the addition of the diarylcarbinol compounds of the present invention showed very high contrast and maximum density values.

We claim:

1. A process for forming a high contrast negative photographic image by development of a silver halide photographic element, including at least a negative acting surface latent image-type silver halide emulsion layer, with an aqueous alkaline developing solution containing a dihydroxybenzene developing agent, a super additive developing agent and an antioxidant at a pH lower than 12 in the presence of a hydrazine compound, wherein at least one layer of said silver halide photographic element comprises, prior to being contacted with said developing solution, a useful contract promoting amount of a diarylcarbinol contrast promoting agent.

2. The process of claim 1 wherein said contrast promoting agent is present in said at least one layer of said silver halide photographic element prior to development sensitizing exposure of said silver halide emulsion layer.

3. The process of claim 1, wherein the diarylcarbinol compound is a diarylmethanol compound.

4. The process of claim 1, wherein the diarylcarbinol compound has the formula (I) or (II):

$$R_1R_2R_3COH \quad (I)$$

$$R_1R_2R_3C(CH_2)_nOH \quad (II)$$

wherein $R_1$ and $R_2$ each represent a substituted or unsubstituted aromatic group, $R_3$ represents a hydrogen atom, a substituted or unsubstituted alkyl group or a substituted or unsubstituted aromatic group and n represents a positive integer from 0 to 4.

5. The process of claim 1, wherein the diarylcarbinol compound has the formula (III):

$$R_1R_2CHOH \quad (III)$$

wherein $R_1$ and $R_2$ each represent a substituted or unsubstituted aromatic group.

6. The process of claim 1 wherein the hydrazine compound is included in the silver halide emulsion layer.

7. The process of claim 1 wherein the developing solution has a pH in the range from 10.50 to 11.50.

8. The process of claim 1 wherein the hydroxybenzene developing agent is hydroquinone.

9. The process of claim 1 wherein the superadditive developing agent is a 3-pyrazolidone compound.

10. The process of claim 1 wherein the antioxidant is a sulfite compound.

11. The process of claim 1 wherein said developing solution comprises an organic antifogging agent selected within the class including a benzotriazole compound and a benzimidazole compound.

12. The process of claim 11 wherein said benzotriazole compound and said benzimidazole compound are without electron-attracting substituents as strong as or stronger than a nitro group.

13. A silver halide photographic element which has not undergone development sensitizing exposure to actinic radiation, including at least one negative acting surface latent image-type silver halide emulsion layer and a contrast promoting hydrazine compound, said element being characterized by the presence of a contrast promoting amount of a diarylcarbinol contrast promoting agent in reactive association with said silver halide emulsion layer.

14. The element of claim 13 wherein said contrast promoting agent comprises a diarylmethanol compound.

15. A silver halide photographic element which has not undergone development sensitizing exposure to actinic radiation, including at least one negative acting surface latent image-type silver halide emulsion layer and a contrast promoting hydrazine compound, said element being characterized by the presence of a contrast promoting amount of a diarylcarbinol contrast promoting agent in reactive association with said silver halide emulsion layer, wherein the diarylcarbinol compound has the formula (I) or (II):

$$R_1R_2R_3COH \quad (I)$$

$$R_1R_2R_3C(CH_2)_nOH \quad (II)$$

wherein $R_1$ and $R_2$ each represent a substituted or unsubstituted aromatic group, $R_3$ represents a hydrogen atom, a substituted or unsubstituted alkyl group and n represents a positive integer from 0 to 4, and wherein said diarylcarbinol is incorporated in the silver halide emulsion layer in an amount from about $10^{-4}$ to $10^{-1}$ mole per mole of silver halide.

16. The silver halide photographic element of claim 15, wherein the diarylcarbinol compound has the formula (III):

$$R_1R_2CHOH \quad (III)$$

wherein $R_1$ and $R_2$ each represent a substituted or unsubstituted aromatic group.

17. The silver halide photographic element of claim 15 wherein a hydrazine compound is incorporated corresponding to the formula:

$$R_4-NHNH-\underset{\underset{O}{\|}}{C}-H$$

wherein $R_4$ represents a substituted or unsubstituted aromatic group.

18. The silver halide photographic element of claim 15 wherein a hydrazine compound is incorporated in an amount from about $5\times10^{-4}$ to $5\times10^{-2}$ mole per mole of silver halide.

* * * * *

UNITED STATES PATENT AND TRADEMARK OFFICE

CERTIFICATE OF CORRECTION

PATENT NO. : 4,777,118

DATED : October 11, 1988

INVENTOR(S) : Kitchin and Marchesano

It is certified that error appears in the above-identified patent and that said Letters Patent is hereby corrected as shown below:

Column 8, line 16 "miole" should be --mole--.

Column 8, line 57 "of" should be --or--.

Column 8, line 63 "aqueos" should be --aqueous--.

Signed and Sealed this

Fourteenth Day of November, 1989

*Attest:*

JEFFREY M. SAMUELS

*Attesting Officer* *Acting Commissioner of Patents and Trademarks*